US012179991B2

(12) United States Patent
Jones et al.

(10) Patent No.: US 12,179,991 B2
(45) Date of Patent: Dec. 31, 2024

(54) PACKAGING ASSEMBLY

(71) Applicant: WestRock MWV, LLC, Atlanta, GA (US)

(72) Inventors: Marty Jones, Glen Allen, VA (US); James D. Knotts, Glen Allen, VA (US)

(73) Assignee: WestRock MWV, LLC, Atlanta, GA (US)

( * ) Notice: Subject to any disclaimer, the term of this patent is extended or adjusted under 35 U.S.C. 154(b) by 612 days.

(21) Appl. No.: 17/291,825

(22) PCT Filed: Nov. 6, 2019

(86) PCT No.: PCT/US2019/059975
§ 371 (c)(1),
(2) Date: May 6, 2021

(87) PCT Pub. No.: WO2020/097148
PCT Pub. Date: May 14, 2020

(65) Prior Publication Data

US 2021/0387792 A1 Dec. 16, 2021

Related U.S. Application Data

(60) Provisional application No. 62/757,802, filed on Nov. 9, 2018.

(51) Int. Cl.

| | |
|---|---|
| ***B65D 83/04*** | (2006.01) |
| ***B65D 5/38*** | (2006.01) |
| ***B65D 5/42*** | (2006.01) |
| ***B65D 5/56*** | (2006.01) |
| ***B65D 5/62*** | (2006.01) |
| ***B65D 75/36*** | (2006.01) |

(52) U.S. Cl.
CPC ..... *B65D 83/0463* (2013.01); *B65D 5/38* (2013.01); *B65D 5/4266* (2013.01); *B65D 5/563* (2013.01); *B65D 5/62* (2013.01); *B65D 75/367* (2013.01)

(58) Field of Classification Search
CPC ..... B65D 5/38; B65D 5/4266; B65D 5/563; B65D 83/0463; B65D 75/367; B65D 2215/04; B65D 2585/56
USPC .... 206/1.5, 528, 531, 532, 468; 229/125.12, 229/125.125
See application file for complete search history.

(56) References Cited

U.S. PATENT DOCUMENTS 6,047,829 A 4/2000 Johnstone et al.
6,230,893 B1 * 5/2001 Karow ..... B65D 83/0463 229/125.125
6,491,211 B1 * 12/2002 Evans ..... B65D 77/02 206/532

(Continued)

OTHER PUBLICATIONS

International Search Report issued in PCT/US2019/059975, dated Jan. 22, 2020.

*Primary Examiner* — Gideon R Weinerth
(74) *Attorney, Agent, or Firm* — Neil G. Cohen; Rohini K. Garg

(57) ABSTRACT

A packaging assembly that includes a carton and an inner member. The carton includes a first flap located within an inner portion thereof. The inner member is configured to be received in the inner portion of the carton. The inner member has an extension that is configured to engage the first flap to restrict the inner member from being separated from the carton. The free end of the first flap includes a cutout.

20 Claims, 7 Drawing Sheets

(56) References Cited

U.S. PATENT DOCUMENTS 6,641,031 B2 * 11/2003 Evans ..... B65D 77/02 206/532
7,658,287 B2 * 2/2010 Hession ..... B65D 83/0463 206/528
7,845,496 B2 * 12/2010 Hession ..... B65D 83/0463 229/125.125
8,499,936 B2 * 8/2013 Albrecht ..... B65D 83/0463 206/531
8,939,281 B2 * 1/2015 Matsuba ..... B65D 25/00 206/459.1
9,067,708 B2 * 6/2015 Weston ..... B65D 59/04
9,376,246 B2 * 6/2016 Jones ..... B65D 75/368
10,543,950 B2 * 1/2020 Hammond ..... B65D 5/38
2003/0047482 A1 3/2003 Jones et al.
2004/0188311 A1 * 9/2004 Paliotta ..... B65D 75/327 206/531
2007/0054525 A1 3/2007 Jones et al.
2007/0251983 A1 * 11/2007 Freeze ..... A61J 7/0069 229/125.125
2007/0272586 A1 * 11/2007 Hession ..... B65D 75/327 206/532
2008/0217205 A1 * 9/2008 Sattel ..... B65D 83/0463 206/467
2009/0095649 A1 * 4/2009 Costa ..... B65D 83/0463 206/530
2009/0184023 A1 * 7/2009 Brollier ..... B65D 83/0463 206/469
2009/0301924 A1 * 12/2009 Rondeau ..... B65D 83/0463 206/468
2010/0084308 A1 4/2010 Rigby
2011/0163156 A1 * 7/2011 Smith ..... B65D 83/0463 229/125.125
2012/0234701 A1 * 9/2012 Albrecht ..... B65D 83/0463 206/1.5
2012/0279889 A1 * 11/2012 Fischer ..... B65D 5/38 206/462
2015/0048000 A1 * 2/2015 Jones ..... B65D 77/0433 206/462
2015/0048001 A1 * 2/2015 Bailey ..... B65D 77/0433 206/468
2015/0307246 A1 * 10/2015 Patwardhan ..... B65D 77/0433 206/1.5
2016/0368689 A1 * 12/2016 Grosskopf ..... A61J 1/035
2019/0233158 A1 * 8/2019 Jones ..... B65D 83/0463
2019/0233159 A1 * 8/2019 Jones ..... B65D 75/367
2019/0337689 A1 * 11/2019 Mazurek ..... B65D 5/503
2020/0180808 A1 * 6/2020 Gauvin ..... B65D 5/38
2020/0262618 A1 * 8/2020 Nelson ..... B65D 5/38
2021/0016939 A1 * 1/2021 Palmer ..... B65D 5/38
2021/0387792 A1 * 12/2021 Jones ..... B65D 5/62
2022/0119171 A1 * 4/2022 Levitz ..... B65D 50/045
2022/0315273 A1 * 10/2022 Dayioglu ..... B65D 5/38
2022/0371802 A1 * 11/2022 Collier ..... B65D 55/0818

* cited by examiner

PACKAGING ASSEMBLY

CROSS REFERENCE TO RELATED APPLICATIONS

This Application a U.S. National Phase Application filed under 35 U.S.C. § 371, based on International PCT Patent Application No. PCT/US2019/059975, filed Nov. 6, 2019, which application claims priority to U.S. Provisional Patent Application No. 62/757,802 filed on Nov. 9, 2018. The entire contents of these applications is incorporated herein by reference.

FIELD

These teachings relate to a packaging assembly that includes a carton and an inner member.

BACKGROUND

A blister card is a type of packaging that includes one or more cavities or blisters for storing articles, like foods, pharmaceuticals, and the like. Some blister cards are configured to be placed inside of a carton for protecting, storing, and/or showcasing, the blister pack and the stored articles.

An example of a blister card and/or carton are disclosed in U.S. Pat. No. 6,230,893, which is incorporated by reference herein for all purposes.

It may be desirable to have a blister card and/or carton that includes one or more features providing at some level of child resistance to access the blister card and the articles therein, while not completely restricting or preventing adults from accessing the blister card and the articles.

It may be desirable to have a blister card and/or carton that includes one or more features that may reduce or eliminate chances of the blister card jamming or hanging up inside the carton during insertion and/or removal of the blister card from the carton.

SUMMARY

These teachings provide an inner member or blister card and a carton that include one or more features providing at some level of child resistance to access the blister card or inner member and the articles therein, while not completely restricting or preventing adults from accessing the blister card and the articles. These teachings provide an inner member or a blister card and/or carton that includes one or more features that may reduce or eliminate chances of the blister card jamming or hanging up inside the carton during insertion and/or removal of the blister card from the carton.

These teachings provide a packaging assembly that includes a carton and an inner member. The carton includes a first flap located within an inner portion thereof. The inner member is configured to be received in the inner portion of the carton. The inner member has an extension that is configured to engage the first flap to restrict the inner member from being separated from the carton. The free end of the first flap includes a cutout.

These teachings also provide a packaging assembly that includes a carton and an inner member. The carton includes a first flap and a second flap. A free end of the first flap includes a first cutout. A free end of the second flap includes a second cutout. The inner member includes one or more blisters and an extension. The extension is configured to engage the first flap to restrict the inner member from being separated from within the carton. The second flap is configured to contact a bottom surface of the inner member.

DETAILED DESCRIPTION

Figure 1:
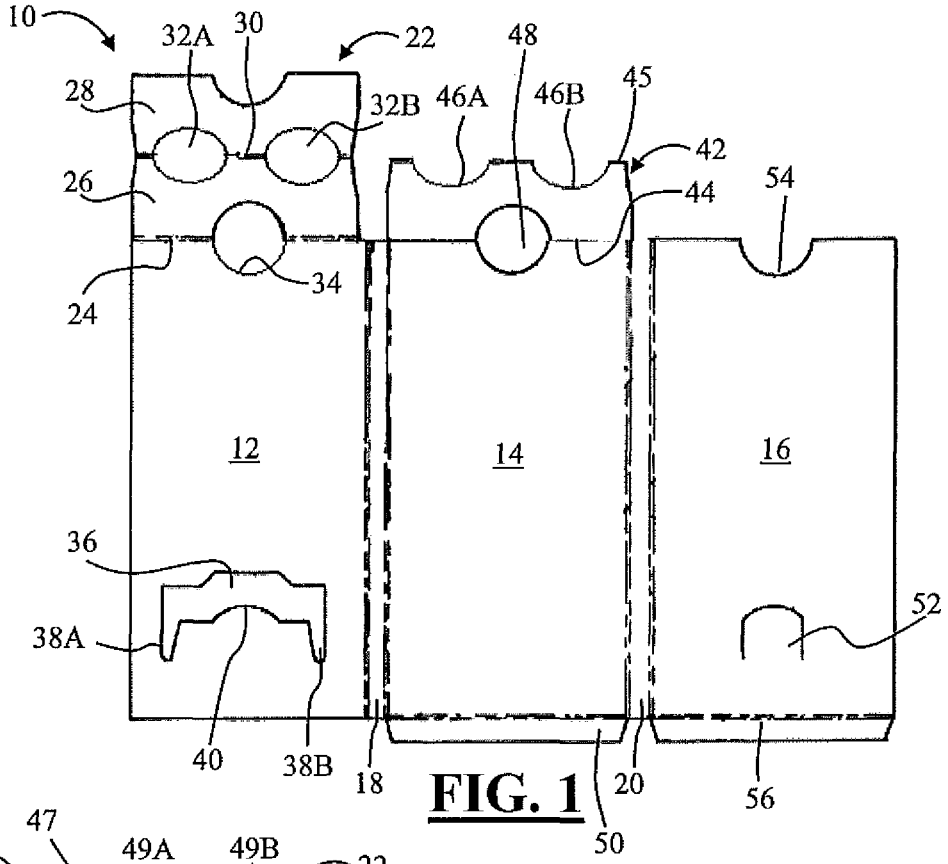
FIG. 1 is a plan view of a blank for forming the carton, according to these teachings.
Figure 9:
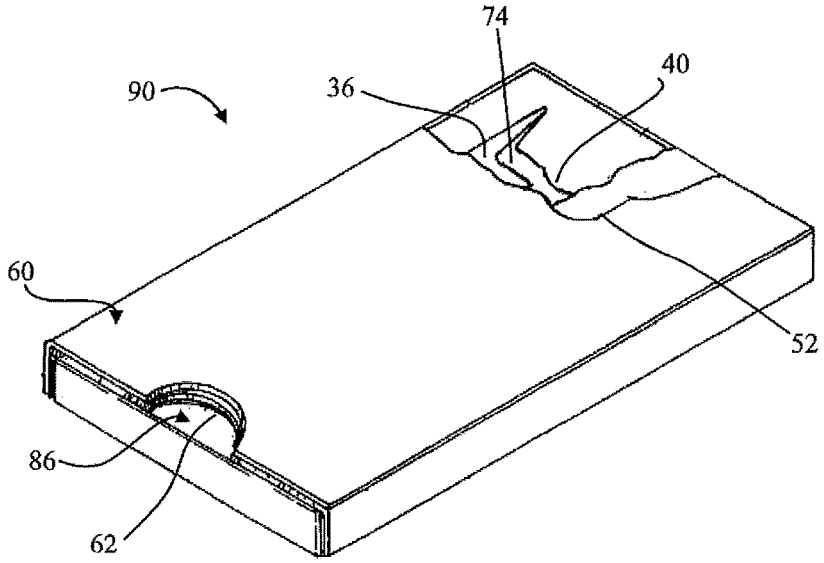
FIG. 9 is a perspective view of a constructed packaging assembly according to these teachings, comprising the carton and the inner member located inside of the carton.

FIG. 1 illustrates a blank 10 for constructing the carton 60 (FIG. 5) of the packaging assembly 90 (FIG. 9). The blank 10 may be formed from a sheet of paperboard, such as, for example, bleached sulphate, solid unbleached sulphate (SUS) or clay-coated newsback (CCNB). Definitively, the term paperboard describes paper within the thickness range of 0.008 to 0.028 inches. The blank 10 or paper board may be clay coated on at least one side surface and occasionally on both sides. The same paperboard may be used to construct the inner member, discussed further below.

The blank 10 comprises first, second, and third carton panels 12, 14, 16. Carton panels 12, 14 are separated by a side panel 18, and carton panels 14, 16 are separated by side panel 20.

A first flap 22 extends from the first carton panel 12 at a fold line 24. The first flap 22 comprises a first portion 26 and a second portion 28 separated by a fold line 30. The first flap 22 comprises a pair of apertures 32A, 32B arranged on both of the portions 26, 28. A cutout 34 is arranged on both of the first portion 26 and first carton panel 12. Fold lines, as used herein, may be a creased portion of the blank 10, or may be a score or thinned-out portion of the blank 10 or may be a perforated portion of the blank. A fold line may function as a living hinge, for example, configured for a panel or flap to freely move relative to another panel or flap.

The first carton panel 12 includes a cutout 36, legs 38A and 38B, and a node or projection 40, all of which cooperate to restrict movement or removal of the inner member 86

(FIG. 8) from within the carton 60, as will be discussed further below with reference to FIG. 9.

A second flap 42 extends from the second carton panel 14 at a fold line 44. A free end 45 of the second flap 42 comprises a pair of cutouts 46A, 46B. A cutout 48 is arranged on both of the second flap 42 and second carton panel 14. An end flap 50 extends from the second carton panel 14 at a fold line.

The third carton panel 16 comprises a release button 52, a cutout, 54, and an end flap extending 56 from the third panel 16 at a fold line.

Figure 2:
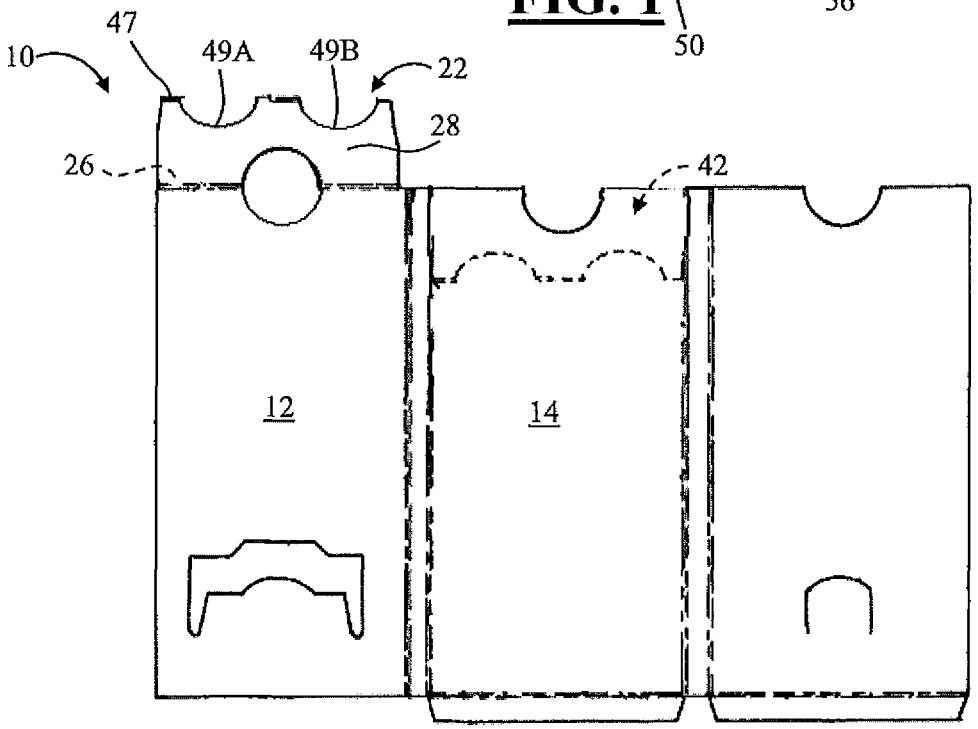
FIG. 2 is a plan view of the blank of FIG. 1, with a first flap and a second flap folded.

FIG. 2 illustrates the blank 10 of FIG. 1, with the second portion 28 folded over or onto the first portion 26, thus forming a free end 47 having cutouts 49A, 49B. The cutouts 49A, 49B are formed as a result of the apertures 32A, 32B from FIG. 1 being folded in half about fold line 30. The second flap 42 is folded under or behind the second carton panel 14.

Figure 3:
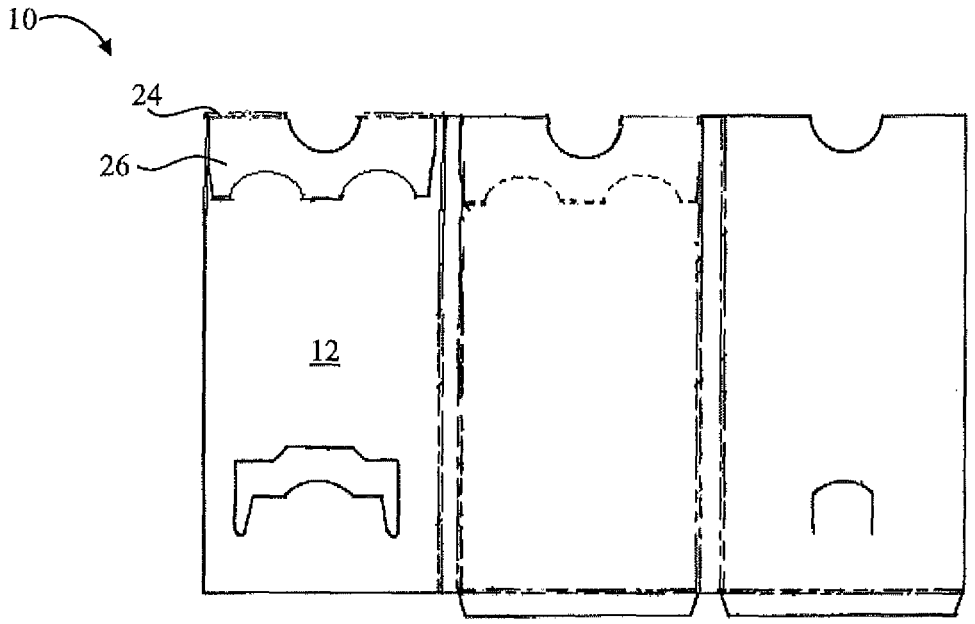
FIG. 3 is a plan view of the blank of FIG. 2, with the first flap folded again.

FIG. 3 illustrates the blank 10 with the first portion 26 folded over or on top of the first carton panel 12 about fold line 24.

Figure 4:
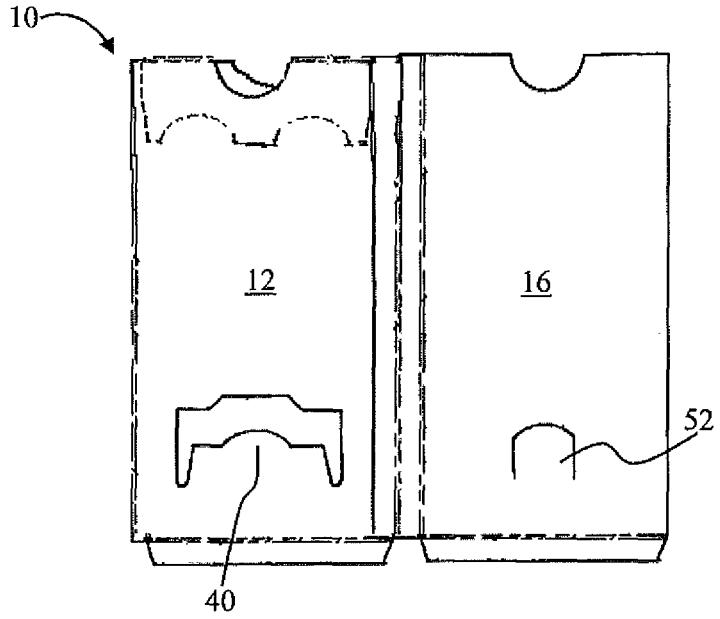
FIG. 4 is a plan view of the blank of FIG. 3, with a first carton panel folded over or onto a second carton panel.

FIG. 4 illustrates the blank 10 with the first carton panel 12 folded over or on top of the second panel 14. The first carton panel 12 and the third carton panel 16 are then folded into contact with each other such that the node 40 and release button 52 are adjacent with one another.

Figure 5:
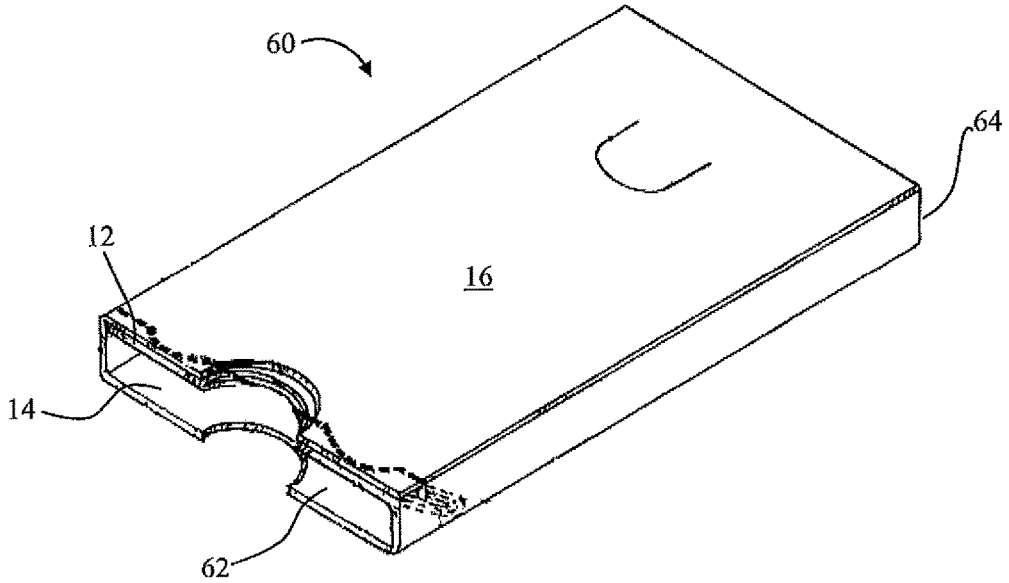
FIG. 5 is a perspective view of the constructed carton.

FIG. 5 illustrates the constructed carton 60. The carton 60 includes an open end 62 and an opposing closed end 64. In some configurations, the closed end 64 may instead be open, or may include a flap that allows access to the inside of the carton 60 through end 62. The carton 60 comprises a 3-dimensional open-ended box, where the carton panels 12, 14, and 16 are generally parallel to each other. The first and third carton panels 12, 16 are in contact with one another, and are spaced apart from the bottom second carton panel 14.

Figure 6A:
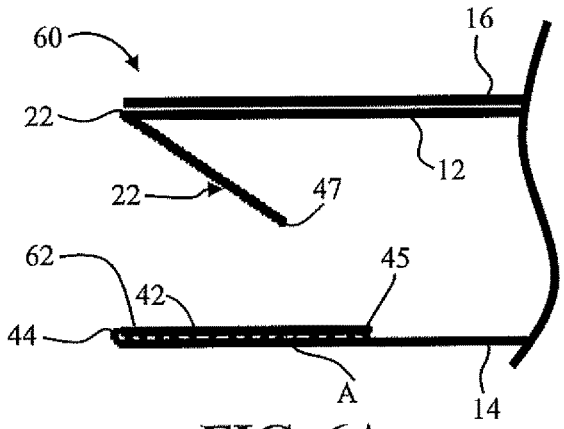
FIG. 6A is a cross-sectional side view of an open end of the constructed carton of FIG. 5.

FIG. 6A illustrates a cross section of the open end 62 of the carton 60. The first flap 22 extends from the first carton panel 12 at an angle defined at the fold line 24. The first flap 22 is free to move or pivot about the fold line 24 relative to the first, second, and third carton panels 12, 14, 16 and also the second flap 42. The first flap 22 may move or pivot relative to the aforementioned panels and flaps when the inner member 86 is inserted, removed, or otherwise moved relative to the constructed carton 60. The free end 47 of the flap 22 faces inwardly into the carton 60.

The second flap 42 is folded onto the second carton panel 14 at fold line 44 and is secured thereto with a fastener, such as an adhesive A. The second flap 42 is in planar contact with the second carton panel 14. The free end 45 of the second flap 42 faces inwardly into the carton 60.

Figure 6B:
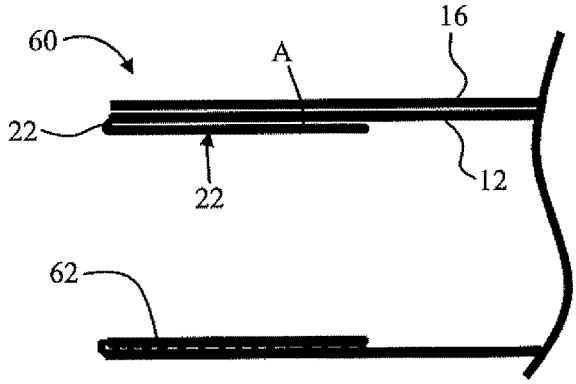
FIG. 6B is a cross-sectional side view of an open end of the constructed carton of FIG. 5.

FIG. 6B also illustrates a cross section of the open end 62 of the constructed carton 60, which is substantially similar to FIG. 6A, except that the first flap 22 is folded about fold line 23 into planar contact with an inside surface of the first carton panel 12, and may be secured thereto with a fastener like an adhesive A. The first flap 22 in this configuration is generally parallel to the first, second, and third carton panels 12, 14, 16 and the second flap 42.

While FIGS. 3 and 6B suggest that a length of both of the flaps 22, 42 is generally the same (i.e., when measured from the fold lines 24, 44 to the corresponding free ends 47, 45), the lengths of the flaps 22, 42 need not be the same. For example, the first flap 22 may be shorter than the second flap 42 as shown in FIG. 6A, or the first flap 22 may be longer than the second flap 42 (not illustrated).

Figure 7:
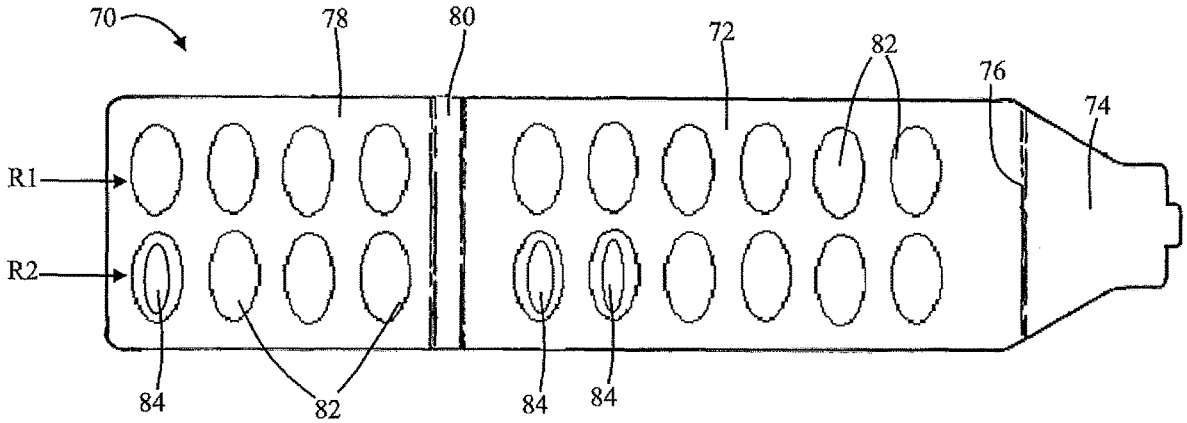
FIG. 7 is a plan view of a blank for forming the blister card or inner member, according to these teachings.
Figure 8:
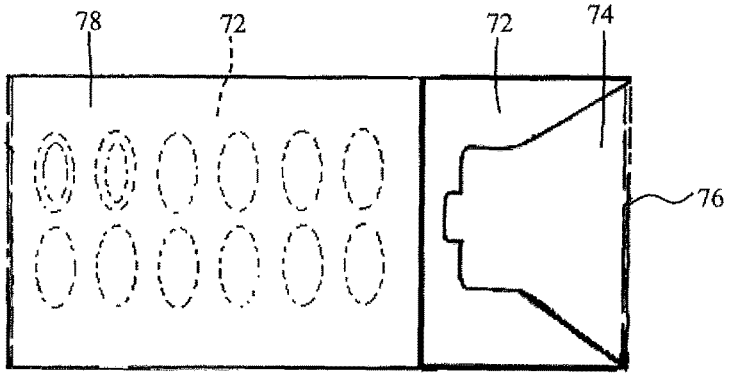
FIG. 8 is a plan view of the blank of FIG. 7, with a first card panel folded over or onto a second card panel, and a card extension folded relative to the second panel.

FIG. 7 illustrates a blank 70 for constructing the blister card or inner member 86 (FIG. 8). The blank 70 comprises a first panel 72. The blank comprises an extension 74 connected to one end of the first panel 72 at a fold line 76. The blank 70 comprises an optional second panel 78 that may be connected to the other end of the first panel 72 via side panel 80 so that the second panel 78 is adjacent to the first panel 72.

The first panel 72 includes one or more blisters or cavities 82 that are configured to house, support, or contain an article 84. However, not all blisters or cavities 82 must contain an article 84. Moreover, some blisters or cavities 82 may contain more than one article 84. The second panel 78 may also include one or more blisters or cavities 82 that are configured to house, support, or contain an article 84; however, in some configurations the second panel 78 may be free of any blisters or cavities 84. A blister or cavity 82 may be a dome shaped housing or bubble that is configured to store, house, or contain an article 84. The blister or cavity 82 may have a circular or oval top, or the blister or cavity 82 may have a square or flat top. The blister or cavity 82 may be made of a clear or at least partially see-through plastic or foil to allow a user to see inside the blister or cavity. Alternatively, the blister or cavity 82 may be made of a colored, dark, or non-see through material, where the contents inside the blister or cavity 82 is obstructed or not visible. The article 84 may be a pharmaceutical product, food, a toy, gum, the like, or a combination thereof.

The blisters or cavities 82 are arranged in rows R1, R2 along a length of the panels 72, 78. While the panels 72, 78 illustrated in FIG. 7 has two rows R1, R2, the panels 72, 78 may have any number of rows R1, R2 of blisters or cavities (e.g., one or more, two or more, three or more, four or more, five or more, six or more, etc. Moreover, the panels 72, 78 may, but need not, have the same number or rows per panel 72, 78. For example, panel 72 may have two rows, while panel 78 has three rows.

FIG. 8 illustrates the constructed inner member 86, which includes the second panel 78 folded over or onto the first panel 72, and the extension 74 folded onto the first panel 72. The second panel 78 folded over or onto the first panel 72 may function like a cover to cover or protect the articles 84 on the first panel 72. The extension 74 is configured to extend at an angle about fold line 76 relative to the first panel 72.

FIG. 9 illustrates a constructed packaging assembly 90, which comprises the blister card or inner member 86 received into the carton 60. The inner member 86 is inserted into the carton 60 until the extension 74 is moved past the opening 36, at which point the extension 74 is configured to spring upwardly about the fold line 76 (FIG. 8) and enter into the opening 36 and be biased against the node 40. Therefore, if a user attempts to remove inner member 86 from within the carton 60 by simply pulling on the inner member 86 through the open end 62 of the carton 60, the extension 74 is configured to slide up along the opening 36 thereby restricting removal of inner member 86 from the carton 60.

In order to deactivate the sliding movement of extension 74, a user may push down or apply a force onto the release button 52 such that release button 52 pushes against the node 40 and then the extension 74 is pushed below the opening 36, thereby preventing extension 74 from sliding up through the opening 36. A user can then pull on the inner member 86 through the open end 62 of the carton 60 and withdrawal the inner member 86 from the carton 60.

Figure 10:
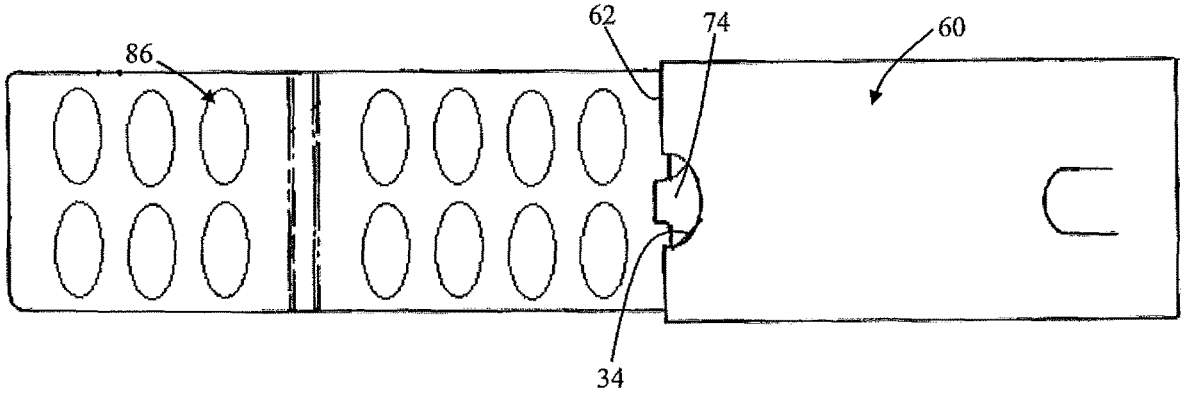
FIG. 10 is a plan view of the inner member partially removed from inside the carton.

FIG. 10 illustrates the inner member 86 at least partially removed or withdrawn from the open end 62 of the carton 60. After the inner member 86 has been at least partially withdrawn from the carton 60, the extension 74 eventually engages or is caught by the cutout 34, thereby restricting or preventing a complete removal of the inner member 86 from the carton 60.

Figure 11A:
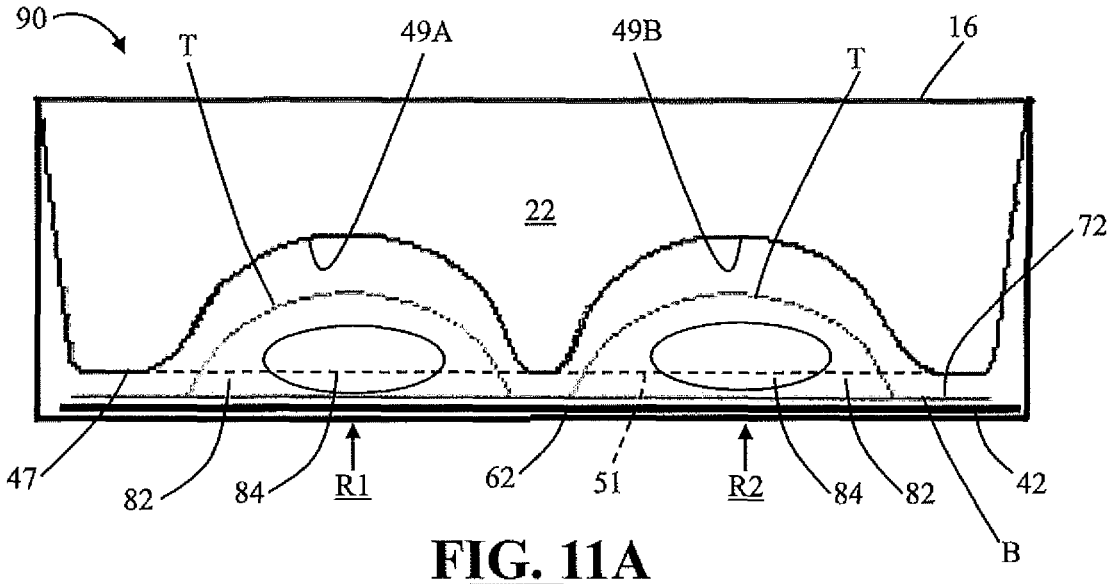
FIG. 11A is an end view of the open end of the packaging assembly.
Figure 11B:
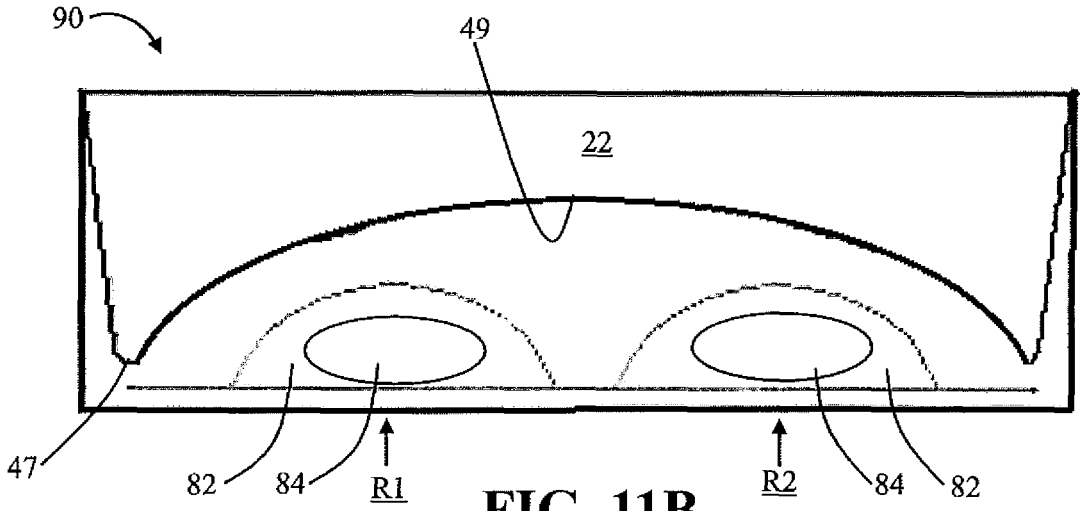
FIG. 11B is an end view of the open end of the packaging assembly.

FIGS. 11A and 11B illustrate a cross section of the packaging assembly 90. More specifically, FIGS. 11A and 11B illustrate a situation if the inner member 86 is inserted back into the open end 62 of the carton 60 without first folding the second panel 78 onto the first panel 72 so that the inner member 86 looks like the configuration illustrated in FIG. 8. In other words, FIGS. 11A and 11B illustrate a situation where the inner member 78 is open like shown in FIG. 10 and then inserted into the open end 62 of the carton 60. Alternatively, 11A and 11B illustrate an inner member 86 that only includes a first panel 72 (i.e., an inner member 86 that does not include a second panel 78).

As illustrated in FIG. 11A, the free end 47 of the first panel 22 comprises a cutout having two arc-shaped cutouts 49A, 49B. As a reminder, the two cutouts 49A, 49B were formed in FIGS. 1-4, via the openings 32A, 32B by way of folding the second portion 28 over the first portion 26 at fold line 30. As the inner member 86 is moved (i.e., pushed or pulled) relative to the carton 60, the blisters or cavities 82, and any articles 84 contained therein in each row R1, R2 pass under a corresponding one of the cutouts 49A, 49B. Accordingly, and advantageously, by not having the free end 47 of the flap 22, or the surface of the free end 47 defining the cutouts 49A, 49B, contact the inner member 70 or the components thereof (i.e., the tops T of the blisters 82, articles 84, etc.), less force may be required to move (insert or remove) the inner member 70 relative to the carton 60. Moreover, by not having the flap 22 or the surface of the free end 47 defining the cutouts 49A, 49B contact the inner member 86 or the components thereof, the inner member 86 may be less prone to jamming during movement of the inner member 86 inside the carton 60 compared to a situation if the free end 47 of the flap 22 had a straight edge or was free of any of the cutouts 49A, 49B, as illustrated by the dashed line and identified by reference numeral 51. The B-side of the first panel 72, identified by reference letter B, is configured to contact, ride along, or be immediately adjacent to the second flap 62, which will be discussed further below with reference to FIGS. 12 and 13. The B-side of the first panel 72 may include a foil, plastic, and/or aluminum material.

FIG. 11B is substantially similar to FIG. 11A, except that the cutout comprises only a single arc-shaped cutout 49. The single arc-shaped cutout 49 may be formed by a single opening, as opposed to the two adjacent openings 32A, 32B, defined in the two portions 26, 28, and then folding portion 28 over portion 26, as was illustrated in FIGS. 1-4 and discussed above. As the inner member 86 is moved (i.e., pushed or pulled) relative to the carton 60, the blisters or cavities 82, and any articles 84 contained therein, in each row R1, R2 pass under the cutout 49. Accordingly, and advantageously, by not having the free end 47 of the flap 22 contact the inner member 86 or the components thereof (i.e., the blisters 82, articles 84, etc.), less force may be required to move (insert or remove) the inner member 86 relative to the carton 60. Moreover, by not having the flap 22 contact the inner member 86 or the components thereof, the inner member 86 may be less prone to jamming during movement of the inner member 86 inside the carton 60 as may be the case if the free end 47 of the flap 22 had a straight edge or was free of the cutout 49, as illustrated in FIG. 11A by the dashed line and identified by reference numeral 51.

Figure 12:
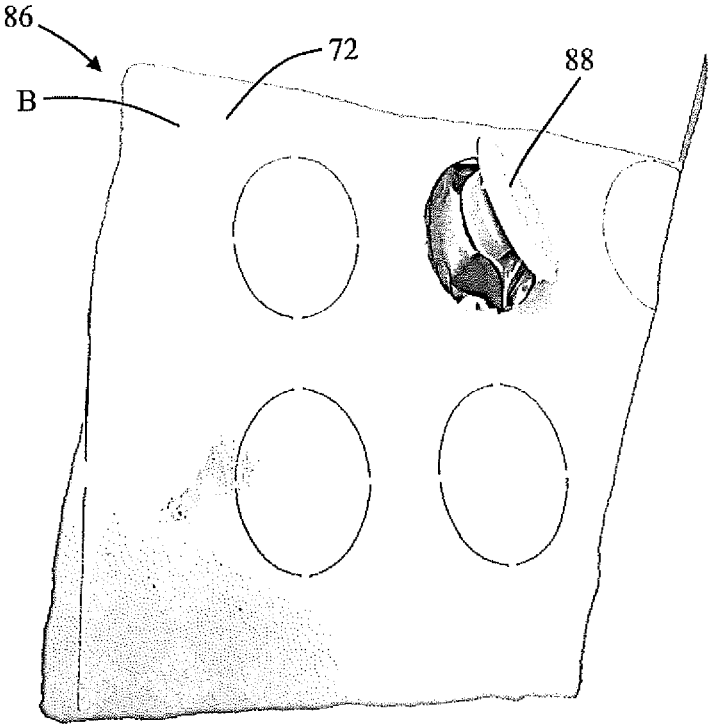
FIG. 12 is a perspective view of the B-side of the inner member.

FIG. 12 illustrates a B-side or surface of the first panel 72 of the inner member 86. After an article 84 has been expelled from within blisters or cavities 82, a chad 88 or portion of the first panel 72 may project or extend from the B-side B of the first panel 72. That is, referring back to FIG. 11A, an article 84 may be dispensed from within a cavity or blister 82 by applying a force onto the top T of a corresponding cavity or blister 82 and then pushing the article 84 through the panel 72 and out of the B-side thereof. A chad 88 or other or portion of the first panel 72 may remain partially attached to the B-side B of the first panel 72, as illustrated in FIG. 12. The chad 88 may be a material of the B-side of the panel 72, such as, for example, plastic, paperboard, or aluminum foil.

Figure 13:
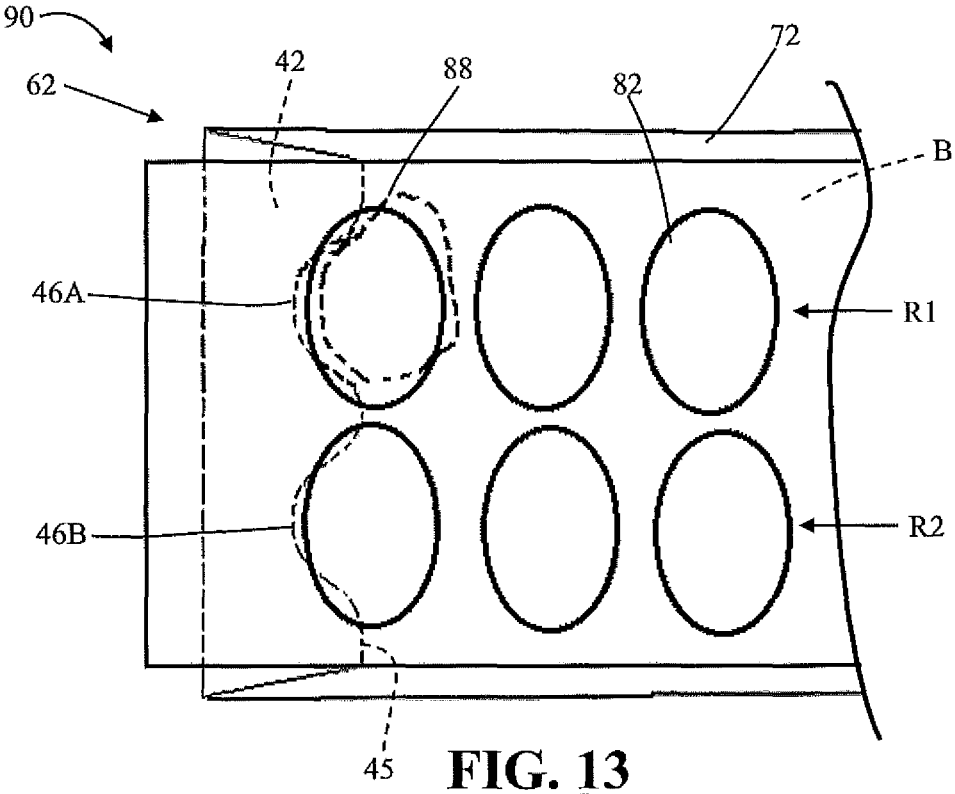
FIG. 13 is a top, cross-sectional view of the packaging assembly.

FIG. 13 illustrates a top, cross-sectional view of the packaging assembly 90 (i.e., the top carton panel 12 removed) and after an article 84 has been removed from one of the cavities or blisters 82, and a chad 88 hanging from B-side B of the first panel 72. As the inner member 86 is then removed from within the carton 60, (i.e., moved or pulled in a left direction though the open end 62 of the carton 60, each row R1, R2 of the cavities or blisters 82 is configured to pass over the cutouts 46A, 46*b* defined in the free end 45 of the second flap 42. As the B-side passes over the cutouts 46A, 46*b*, the cutouts 46A, 46B are configured to engage any chads 88 that hang or project from the B-side B of the panel 72 and either move or fold the chad 88 against the B-side of the panel 72, or, preferably, pull and separate the chad 88 from the panel 72.

As can be seen in FIG. 13, the geometry of the cutouts 46A, 46B is different than the cavities or blisters 82. More specifically, a radius of each of the cutouts 46A, 46B is smaller than a radius of the cavities or blisters 82. However, in some configurations, a radius of one or both of the cutouts 46A, 46B may be substantially the same size or larger than a radius of the cavities or blisters 82.

As disclosed herein, a free end of the first flap comprises a cutout, and a free end of the second flap comprises a second cutout. It is understood that one or both of the cutouts may have any suitable shape. For example, the cutout may have an arc shape, a circular or oval shape, any curved shape, or a combination thereof. One or more of the edges defining the cutout may also be linear, as opposed to being curved shape. For example, the cutout may have a square, triangle, or rectangular shape. The cutout may have angular or rectilinear edges or surfaces. The cutout may be a triangular, square, rectangular, or polygon shape. The cutouts may be formed by cutting or punching out a section of the first flap or the second flap. In some configurations, the cutout may be formed by folding or otherwise distorting the fee end of one or both of the flaps.

One or both of the cutouts may have any suitable shape that allows for the one or more cavities or blisters to pass thereunder without the surfaces of the cutout contacting the card, the blisters, or both. Alternatively, one or both of the cutouts may have any suitable shape that allows for the one or more cavities or blisters to pass thereunder with a very slight interference with the surfaces of the cutout contacting the card, the blisters, or both It is understood that any of the method steps disclosed herein for constructing the carton and/or the inner member can be performed in virtually any order. Moreover, one or more of the method steps can be combined with other steps; can be omitted or eliminated; can be repeated; and/or can separated into individual or additional steps.

The explanations and illustrations presented herein are intended to acquaint others skilled in the art with the invention, its principles, and its practical application. The above description is intended to be illustrative and not restrictive. Those skilled in the art may adapt and apply the invention in its numerous forms, as may be best suited to the requirements of a particular use.

Accordingly, the specific embodiments of the present invention as set forth are not intended as being exhaustive or limiting of the teachings. The scope of the teachings should, therefore, be determined not with reference to this description, but should instead be determined with reference to the appended claims, along with the full scope of equivalents to which such claims are entitled. The omission in the following claims of any aspect of subject matter that is disclosed herein is not a disclaimer of such subject matter, nor should it be regarded that the inventors did not consider such subject matter to be part of the disclosed inventive subject matter.

Plural elements or steps can be provided by a single integrated element or step. Alternatively, a single element or step might be divided into separate plural elements or steps.

The disclosure of "a" or "one" to describe an element or step is not intended to foreclose additional elements or steps.

While the terms first, second, third, etc., may be used herein to describe various elements, components, regions, layers and/or sections, these elements, components, regions, layers and/or sections should not be limited by these terms. These terms may be used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The disclosures of all articles and references, including patent applications and publications, are incorporated by reference for all purposes. Other combinations are also possible as will be gleaned from the following claims, which are also hereby incorporated by reference into this written description.

The invention claimed is:

1. A packaging assembly comprising:

a carton comprising a first flap and a second flap both of which are located within an inner portion thereof, wherein two first cut-outs are defined at a free end of the first flap; and two second cut-outs are defined at a free end of the second flap, wherein the first flap is secured to a first carton panel of the carton and the second flap is secured to a second carton panel of the carton, an inner member configured to be received in the inner portion of the carton, the inner member comprises an extension, the extension is configured to engage the first flap to restrict the inner member from being separated from the carton.

2. The packaging according to claim 1, wherein the inner member comprises one or more blisters, and the one or more blisters are configured to pass under the two first cutouts when the inner member is moved relative to the carton.

3. The packaging according claim 2, wherein the one or more blisters are configured to pass under the two first cutouts without the one or more blisters contacting a surface defining the two first cutouts when the inner member is moved relative to the carton.

4. The packaging assembly according to claim 1, wherein the inner member comprises two rows of blisters, and when the inner member is moved relative to the outer carton, each row is configured to pass under a corresponding one of the two first cutouts.

5. The packaging according to claim 1, wherein the first flap is generally parallel to the first carton panel.

6. The packaging according to claim 5, wherein the first flap is connected to an edge of the first carton panel at a fold line.

7. The packaging according to claim 1, wherein the first flap is angled relative to the first carton panel.

8. The packaging according to claim 7, wherein the first flap is free to move relative to the first carton panel.

9. The packaging according to claim 1, wherein the two second cutouts are configured to engage a bottom surface of the inner member and/or one or more chads extending from the bottom surface of the inner member when the inner member is moved relative to the outer carton.

10. The packaging assembly according to claim 1, wherein the two second cutouts comprises two arc-shaped cutouts, and the inner member comprises two rows of articles, and when the inner member is moved relative to the outer carton, chads extending from the bottom surface of the inner member pass a corresponding one of the two arc-shaped cutouts.

11. The packaging according to claim 1, wherein the second flap is generally parallel to the second panel.

12. The packaging according to claim 11, wherein the first carton panel opposes the second carton panel.

13. The packaging assembly according to claim 1, wherein the two first cutouts comprises two circular cutouts, and the inner member comprises two rows each comprising one or more blisters, the two rows are generally aligned with the two circular cutouts when the inner member is received inside the carton.

14. The packaging assembly according to claim 1, wherein the two first cutouts comprises two arc-shaped cutouts, and the inner member comprises two rows each comprising one or more blisters, the two rows are generally aligned with the two arc-shaped cutouts when the inner member is received inside the carton.

15. The packaging assembly according to claim 1, wherein the, the inner member comprises one or more blisters, and the two second cutouts have a smaller radius than a radius of the one or more blisters.

16. The packaging assembly according to claim 1, wherein the first lap is inclined relative to the second flap.

17. The packaging assembly according to claim 1, wherein the inner member comprises one or more blisters and the two second cutouts have a radius substantially larger that a radius of the one or more blisters.

18. The packaging assembly according to claim 1, wherein the inner member comprises one or more blisters, and the two second cutouts have a radius substantially same as a radius of the one or more blisters.

19. The packaging assembly according to claim 1 wherein the second flap is folded on of under or behind the second carton panel.

20. The packaging assembly according to claim 1 wherein one the first two cutouts and the second two cutouts are shaped to be substantially same as the one or more blisters.

* * * * *